US006193549B1

(12) United States Patent
Suzuki et al.

(10) Patent No.: US 6,193,549 B1
(45) Date of Patent: Feb. 27, 2001

(54) WATERPROOF CONNECTOR FOR ELECTRICAL TERMINALS

(75) Inventors: Izumi Suzuki; Yukihiro Fukatsu; Kiyofumi Ichida, all of Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/545,830

(22) Filed: Apr. 10, 2000

(30) Foreign Application Priority Data

Apr. 13, 1999 (JP) ..... 11-105919
Apr. 13, 1999 (JP) ..... 11-105920

(51) Int. Cl.[7] ..... H01R 13/40
(52) U.S. Cl. ..... 439/589; 439/511
(58) Field of Search ..... 439/587, 589, 439/507, 509, 511

(56) References Cited

U.S. PATENT DOCUMENTS 4,690,478 * 9/1987 Rahrig et al. ..... 439/587
5,000,699 * 3/1991 Nadin ..... 439/511
5,112,239 * 5/1992 Yagi et al. ..... 439/511
5,201,667 * 4/1993 Endo et al. ..... 439/509

FOREIGN PATENT DOCUMENTS 2-61082 5/1990 (JP) .
4-42082 4/1992 (JP) .
9-213436 8/1997 (JP) .

* cited by examiner

*Primary Examiner*—T. C. Patel
(74) *Attorney, Agent, or Firm*—Oliff & Berridge, PLC

(57) ABSTRACT

A waterproof connector for electrical terminals has a housing containing cavities for the electrical terminals arranged in upper and lower rows. Bus bar units are fitted in the rows of cavities respectively to connect the electrical terminals in a predetermined pattern. A sealing member is installed on a rear end of the connector housing and held by a seal holder. The electrical wires connected with the electrical terminals are sealed against the sealing member. A closed end cap is installed on the connector housing from the front end and a lip portion on the peripheral edge of the sealing member seals against the inner peripheral surface of the cap. To permit discrimination of the orientation of the connector, the seal holder may have an asymmetrical shape.

14 Claims, 13 Drawing Sheets

WATERPROOF CONNECTOR FOR ELECTRICAL TERMINALS

BACKGROUND OF THE INVENTION

1. Field of Invention

The invention relates to a waterproof connector for electrical terminals, particularly a connector for use in the wiring of a vehicle such as an automobile.

2. Description of Related Art

FIG. 15 shows one known waterproof connector. In a female connector housing 100 shown in FIG. 15, cavities 101 accommodating female terminals 102 are arranged in a plurality of widthwise rows. Bus bar holders 104 each incorporating a bus bar 103 can be fitted in each of the upper row and lower row cavities 101 so that the terminals 102 can be connected in a predetermined pattern.

To waterproof this connector a one-piece rubber plug 105 is installed on a rear portion of the female connector housing 100. Electrical wire insertion openings 106 through which the respective terminals 102 are insertable are formed through the rubber plug 105 and seal to electrical wires 107 connected with the respective terminals 102. A holder 108 installed at the rear end of the housing 100 prevents the rubber plug 105 from being removed from the housing 100. Sealing of gaps between the bus bar holders 104 and the cavities 101 is obtained by contact of the inner surfaces of the holders 104 with rubber rings 109 provided for each of the cavities 101.

SUMMARY OF THE INVENTION

However, in this waterproof construction, two rubber rings 109 are used for the two bus bar holders 104. It may be preferable to reduce the number of parts. Further, depending on the particular specification, some of the upper or lower level cavities 101 are entirely vacant. In such a case, unless the measure of setting bus bars in the vacant cavity row is taken, it is unavoidable that water penetrates into the female connector housing 100. It is wasteful to use waterproof parts for the cavities 101 not in use.

The present invention seeks to solve the above-described problems. Therefore, it is an object of the present invention to provide a waterproof connector having a simple construction and yet capable of accomplishing a desirable level of waterproofing.

According to the invention in one aspect there is provided a waterproof connector for electrical terminals. The connector has a terminal housing having a front end and a rear end and a plurality of cavities extending in a direction from the front end to the rear end of the terminal housing and adapted to receive electrical terminals. The cavities are arranged in at least one row. The connector also has at least one bus bar installed on the terminal housing from the front end thereof, whereby the bus bar projects into the cavities to make contact with the terminals when the terminals are installed on the housing. There is a cap installable on the housing from the front end thereof so as to cover the housing and the bus bar, and a sealing member mounted at the rear end of the housing and having a plurality of apertures through which the terminals are passed into said cavities, with the apertures then sealing against electrical wires connected to the terminals. The sealing member has a periphery which seals to an inner peripheral surface of the cap when the cap is installed on the housing.

Preferably there is provided a seal holding member that locks to the terminal housing and sandwiches the sealing member between itself and the housing, the seal holding member and the cap having cooperating locking members.

Preferably also the terminal housing or the seal holding member has at least one locating device that positions the sealing member. This achieves accurate location of the cap.

In the invention, the terminals can be connected in a predetermined pattern by fitting the bus bar or bars, which may be held in bus bar holders, in the cavities which are preferably arranged widthwise in a plurality of vertical rows in the housing. To seal the electrical wires connected with the terminals, the edge of the sealing hole of the sealing member closely contacts the coating of the electric wire. To seal the gaps between the bus bar holders and the connector housing, a sealing edge formed at the peripheral edge of the sealing member closely contacts the cap accommodating the bus bar holders and the housing.

Thus one sealing member can be used to seal against both the electrical wires and the gaps between bus bars/bus bar holders and the terminal housing. Thus, a smaller number of parts is used for the waterproof connector of the present invention than in the prior art, in which the sealing functions are performed separately. Further, because the cap can cover the bus bar holders and the connector housing, it is a simple matter to maintain the waterproofing of the connector when cavities of any of the rows are vacant, e.g. by blocking the vacant cavity with resin.

A further problem can arise during assembly of a connector of this type.

In assembling the connector from the sealing member and the seal holding member, an automatic machine installs the sealing member and the seal holding member on the terminal housing. Then, the insertion of the terminals and the installation of the bus bars/bus bar holders and the cap is carried out manually. To insert the predetermined terminals into the predetermined cavity correctly, it is necessary for the operator to discriminate the upper and lower sides of the housing. Thus, the housing, the sealing member, and the seal holding member may be formed trapezoidally in their sectional shapes (shape seen in the terminal insertion direction), so that they are vertically directional.

However, because the vertically directional parts are installed on the housing by the automatic machine, it is necessary to provide a parts feeder for supplying the parts to the automatic machine with a mechanism for discriminating the orientation of the parts and correcting their orientation. Thus, the parts feeder has a complicated construction.

Therefore, with an object of allowing a parts feeder for supplying parts to an automatic assembly machine to have a simple construction, the cavities of the waterproof connector are preferably elongate and parallel, and are symmetrically arranged in at least one planar array to form (a) a first symmetry plane which is parallel to or coincident with the plane of the planar array, and/or (b) a second symmetry plane which is perpendicular to said planar array, while the seal holding member of the waterproof connector has an external shape which is asymmetrical with respect to the first and/or second symmetry plane.

The sealing member and the terminal housing may be symmetrical with respect to a 180° rotation about an axis parallel to a line of insertion of the terminals. Preferably, at least one convex portion and/or at least one concave portion is formed on a peripheral surface of the seal holder so as to give the seal holder an asymmetrical external shape.

In some embodiments of the invention, because the seal holding member has an asymmetrical configuration, an operator can recognize the orientation of the seal holder, namely, the address of the terminal insertion opening. Thus, the operator can insert the terminals into the predetermined cavities correctly. Thus, the terminals are connected in a correct pattern. Because it is possible to allow the sealing member and the housing to have a 180° rotation symmetry axis respectively, a parts feeder for supplying the parts to an automatic machine is allowed to have a simple construction.

It is possible to recognize the orientation of the seal holding easily and reliably by visually checking the one or more convex portions and/or the one or more concave portions formed on the peripheral surface of the seal holding member.

BRIEF DESCRIPTION OF THE DRAWINGS

Embodiments of the invention will now be described by way of non-limitative example with reference to the accompanying drawings, in which.

DETAILED DESCRIPTION OF PREFERRED EMBODIMENTS

Figure 1:
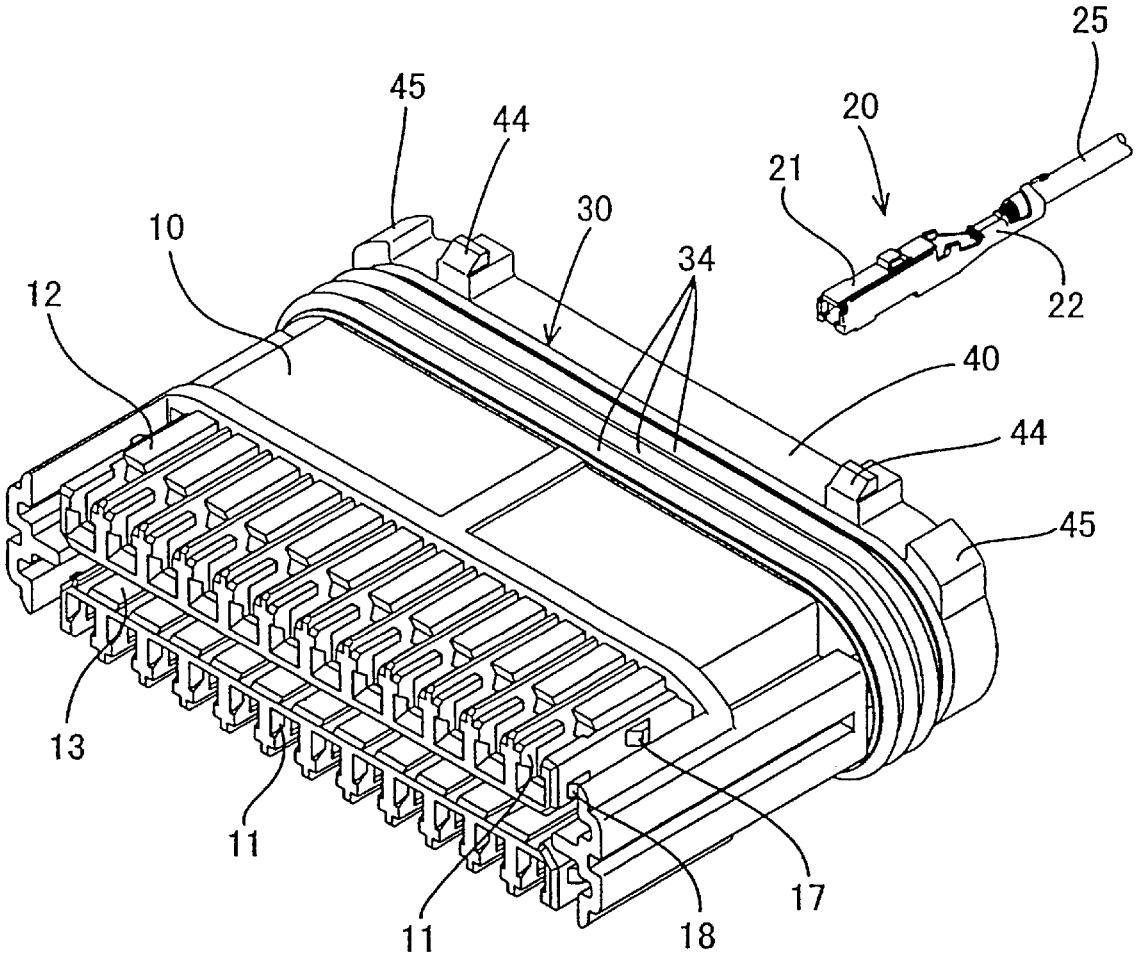
FIG. 1 is a perspective view of a housing, sealing member and seal holder of a connector according to the invention.

A connector embodying the present invention is described in conjunction with FIGS. 1 to 14. The connector connects a plurality of terminals 20 in a predetermined connection pattern and includes a housing 10, a plurality of the terminals 20, a sealing member 30, a seal holder 40, two bus bar units 50, and a cap 60.

The housing 10 is made of a relatively rigid synthetic resin material. As shown in FIG. 1, the housing 10 has cavities 11 arranged in upper and lower rows and extending through the housing 10 in a front-to-rear direction. In each of the upper and lower rows, the cavities 11 may be arranged widthwise at regular intervals. The front half regions of the upper-row cavities 11 and the lower-row cavities 11 are open at the upper and lower surfaces of the housing 10, respectively. In each open portion, locking lances 12 project forward in a cantilever manner. Between the upper and lower rows of cavities 11 there is formed a wide recess 13 for allowing the peripheral walls of the bus bar units 50, described below, to penetrate. An upper surface wall and a lower surface wall of the recess 13 are partly cut away to allow communication with the cavities 11.

There are two holding projections 14 (see FIG. 6) projecting rearward from right and left ends of the rear end surface of the housing 10. There are also formed two deformation prevention projections 15 projecting rearward from positions located between the two holding projections 14. The deformation prevention projections 15 are parallel to the holding projections 14. The projections 14 and 15 position the housing 10 with respect to the sealing member 30 and seal holder 40. The front half (portion close to the housing 10) of the holding projection 14 is a base portion 14A that may be circular in section, while the rear half is a locking portion 14B not circular in section and narrower than the base portion 14A. The locking portion 14B locks to the seal holder 40, thus preventing the seal holder 40 from being removed rearward from the housing 10. The deformation prevention projections 15 penetrate tightly through fit-in holes 33 of the sealing member 30, shown in FIG. 7, thus preventing vertical or lateral deformation of the seal member 30, which is interposed between the housing 10 and the seal holder 40.

The housing 10 may be symmetrical with respect to an axis parallel to lines of insertion of the terminals 20 into the cavities 11. That is, the housing 10 may be symmetrical vertically, i.e., symmetrical with respect to a widthwise plane of symmetry of the array of terminals 20 inserted into the cavities 11, and symmetrical horizontally, i.e., symmetrical with respect to a plane perpendicular to this widthwise plane of symmetry.

Each terminal 20 is made of a metal plate material punched and bent into a predetermined configuration. The front half part of each terminal 20 may be formed as a square pillar-shaped mating portion 21 open forward and rearward. The rear half of each terminal 20 is formed as an electric wire connection portion 22 that may be crimped to the core of an electrical wire 25.

Figure 11:
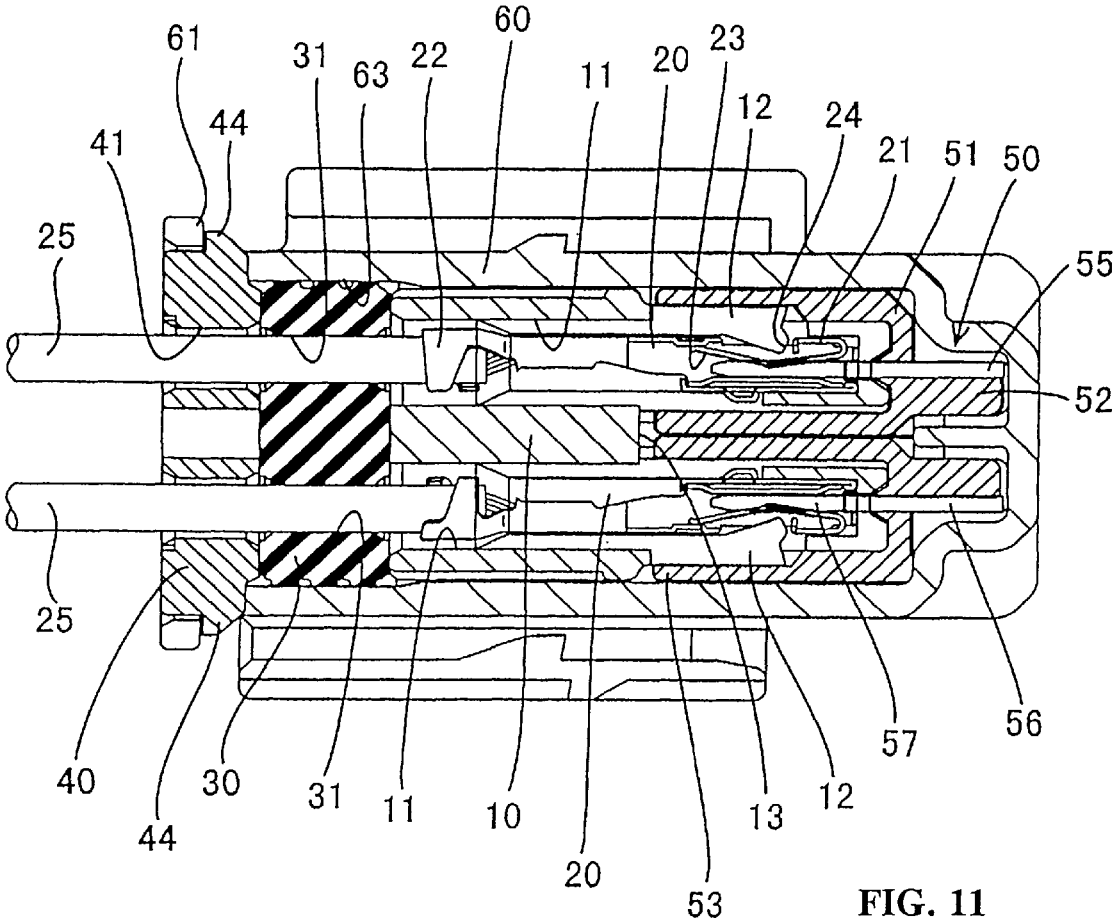
FIG. 11 is a sectional view of the assembled state on line 11—11 of FIG. 4 including terminals in connector cavities.

As shown in FIG. 11, a resilient contact piece 23 that contacts a connection piece 57 of a bus bar 55 is formed inside the mating portion 21. A locking hole 24, which is engaged by the locking lance 12 of the housing 10, is formed on a peripheral wall of the mating portion 21. Each terminal 20 is inserted into a respective cavity 11 of the housing 10 by passing it through the seal member 30 and the seal holder 40 installed on the housing 10 from the rear of the housing 10. Immediately before the terminal 20 reaches its normal insertion position, the locking lance 12 interferes with the peripheral surface of the mating portion 21. Therefore, the lance 12 flexes elastically outward from the housing 10. When the terminal 20 reaches the normal insertion position, the lance 12 is elastically restored to its original state and is engaged in the locking hole 24, thus preventing the terminal 20 from being removed from the cavity 11. The orientation of the terminals in the upper-row of cavities 11 is preferably reversed relative to that of the terminals in the lower cavity row.

Figure 12:
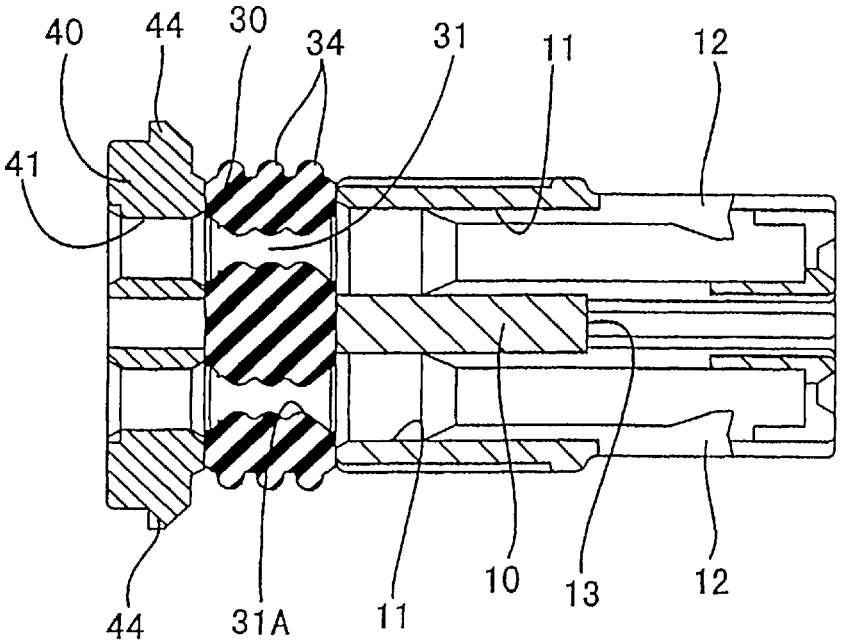
FIG. 12 is a sectional view on line 12—12 of FIG. 5.
Figure 13:
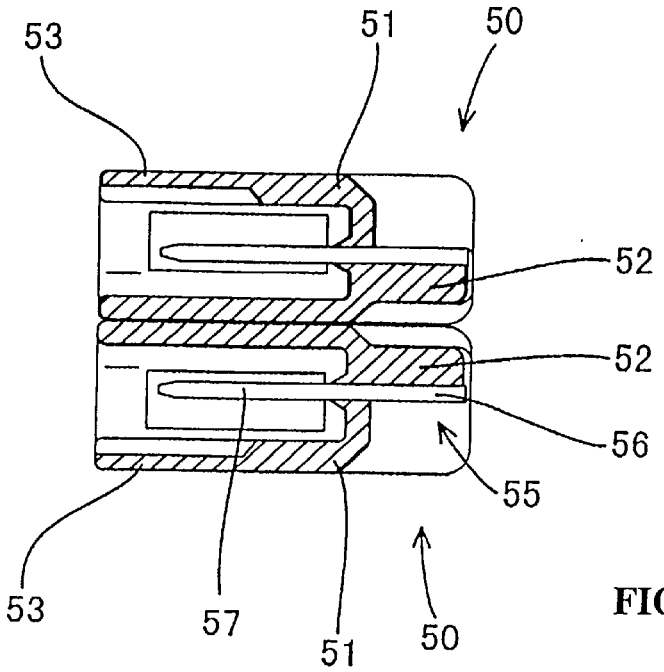
FIG. 13 is a sectional view of the bus bar holder on line 13—13 of FIG. 9.
Figure 14:
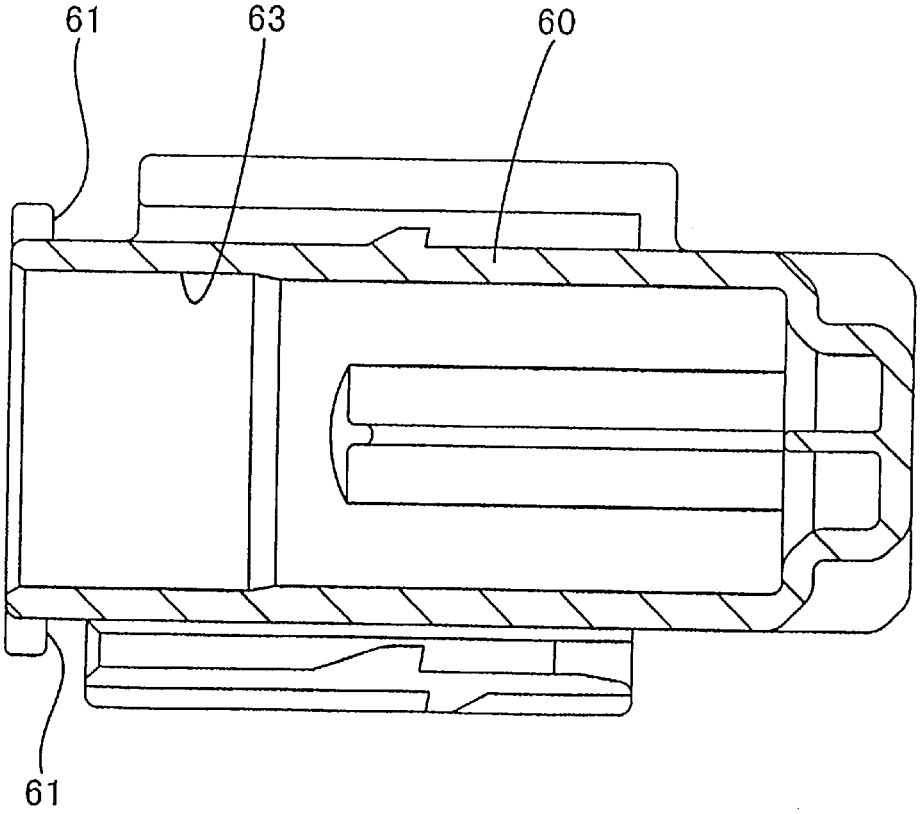
FIG. 14 is a sectional view of the cap on line 14—14 of FIG. 10.
Figure 15:
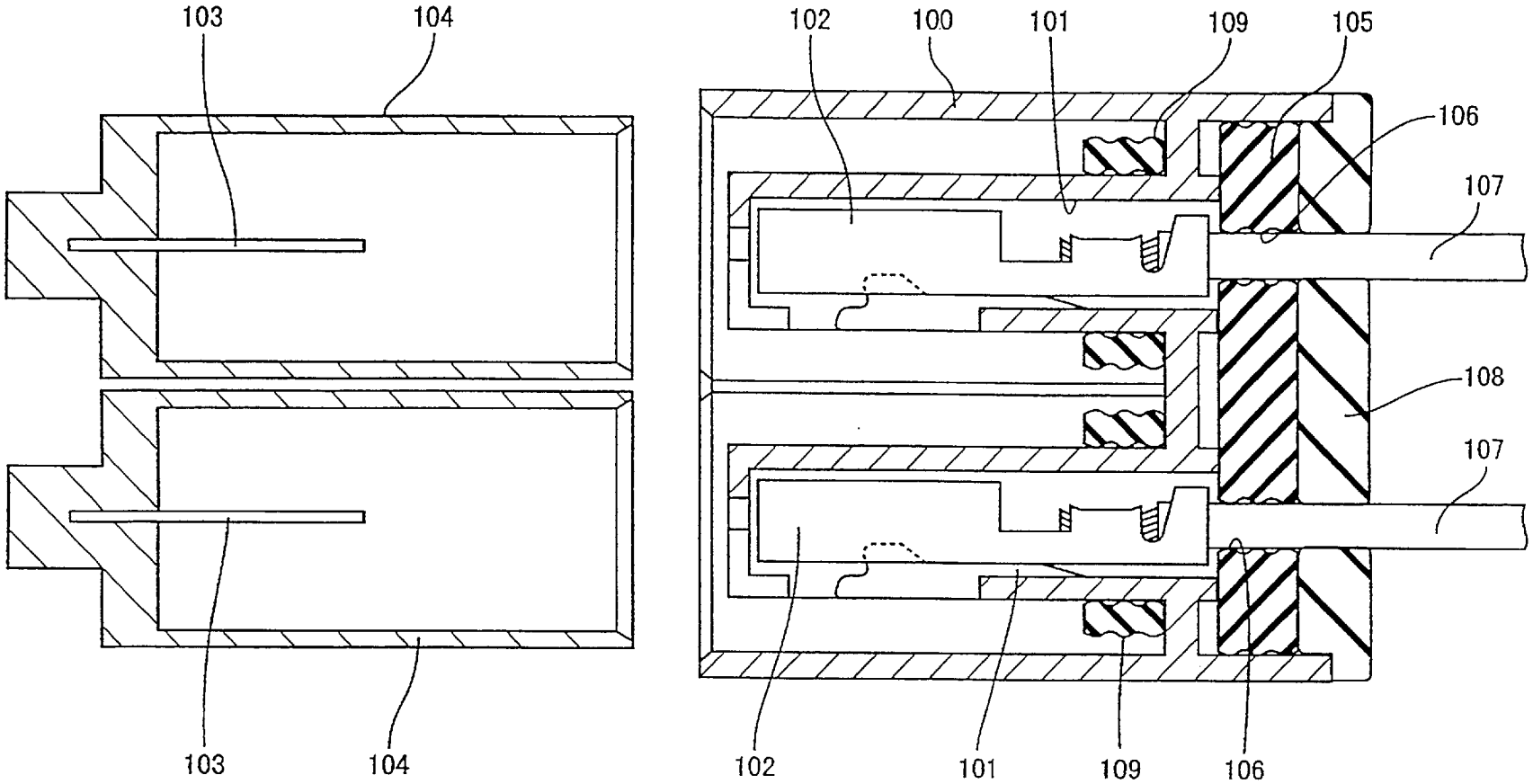
FIG. 15 PRIOR ART
FIG. 15 is a sectional view showing the sealing construction of a conventional connector.

The sealing member 30 is made of rubber, oval-shaped, and thick. The sealing member 30 is installed on the housing 10 and is sandwiched between the rear end surface of the housing 10 and the front end surface of the seal holder 40. A plurality of sealing holes 31 open at the front and rear surfaces of the sealing member 30 are formed coincident with the cavities 11 of the housing 10. Each sealing hole 31 may be circular, for example. As shown in FIG. 12, a lip portion 31A of corrugated shape having, for example, three convexities is circumferentially formed on the inner peripheral surface of each sealing hole 31. The inner diameter of the lip portion 31A is smaller than the outer diameter of the coating of the wire 25. When the wire 25 is in the sealing hole 31, the lip portion 31A contacts the peripheral surface of the wire 25 elastically, thus sealing around the wire 25.

Figure 7:
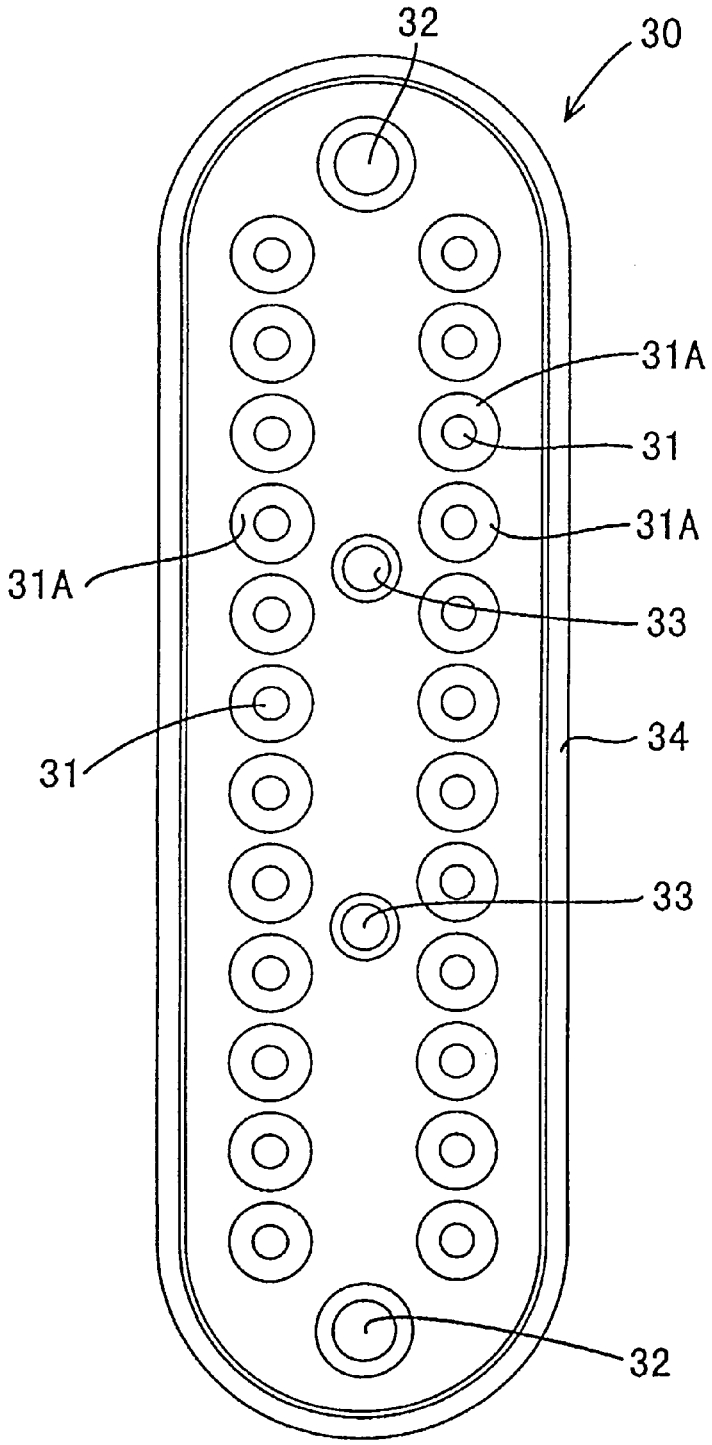
FIG. 7 is a rear view of the sealing member.

As shown in FIG. 7, in the sealing member 30, there are fit-in holes 32 and 33 in the front-to-back direction to receive the holding projections 14 and the deformation prevention projections 15, respectively. The inner diameter of the fit-in hole 32 is slightly smaller than the outer diameter of the holding projection 14. The inner diameter of the fit-in hole 33 is slightly smaller than the outer diameter of the deformation prevention projection 15. Thus, it is possible to seal against the projections 14 and 15.

The peripheral edge of the sealing member 30 is formed as a corrugated sealing edge. A lip portion 34 having, for example, three convexities approximately semi-circular in section extends circumferentially around the sealing member 30. The lip portion 34 contacts the inner peripheral surface of the cap 60 elastically, thus sealing between the sealing member 30 and the cap 60.

Similarly to the housing 10, the sealing member 30 may be symmetrical with respect to an axis parallel to the lines of insertion of the terminal fixtures 20 into the cavities 11.

The seal holder 40 is made of a relatively rigid synthetic resin material. Similarly to the sealing member 30, the seal holder 40 may be oval-shaped and thick. The lip portion 34 formed on the periphery of the sealing member 30 is slightly larger than the periphery of the seal holder 40. A plurality of terminal insertion openings 41 extend between the front and rear end surfaces of the seal holder 40 in correspondence to the cavities 11 and the sealing holes 31. Each terminal 20 is inserted into a respective cavity 11 through a respective terminal insertion opening 41.

Figure 8:
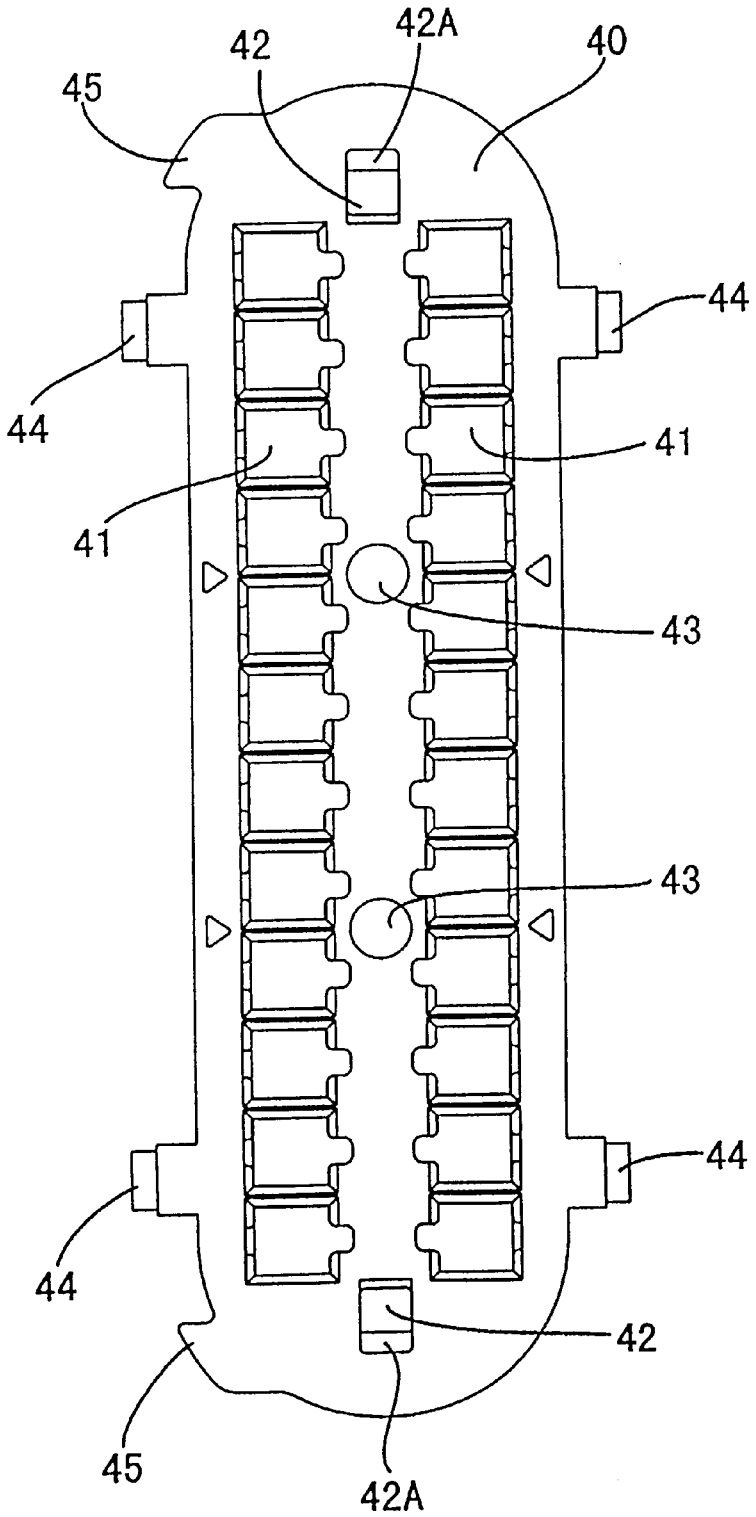
FIG. 8 is a rear view of the seal holder.

As shown in FIG. 8, a pair of removal prevention holes 42 matching the holding projections 14 of the housing 10 is formed on the seal holder 40. The locking piece 14B of each holding projection 14 is locked to a stepped receiving portion 42A formed on an inner wall of a respective removal prevention hole 42, thus preventing the seal holder 40 from being removed from the housing 10. At positions of the seal holder 40 matching the deformation prevention projections 15 of the housing 10, there are formed deformation prevention holes 43 into which the front end portions of the deformation prevention projections 15 are fitted. Thereby the deformation prevention projections 15 support against deformation.

Locking projections 44 are formed at each end of upper and lower flat peripheral surfaces of the seal holder 40. The locking projections 44 engage the cap 60, thus hindering the cap 60 from being easily removed from the housing 10, the sealing member 30, and the seal holder 40. An index projection 45 is formed in each circular arc-shaped region located at right and left ends of the peripheral surface of the seal holder 40. Each of the index projections 45 is formed such that the inward side thereof is on a level higher than that of the outward side thereof. The index projections 45 serve as indexes for checking the upper and lower sides of the housing 10 when the terminal fixture 20 is inserted into the cavity 11.

Owing to the formation of the index projections 45, the seal holder 40 has a shape which is horizontally symmetrical, i.e., symmetrical with respect to the plane perpendicular to the widthwise plane of symmetry of the terminals 20 inserted into the cavities 11, but vertically asymmetrical, i.e., asymmetrical with respect to the plane of symmetry of the terminals 20 inserted into the cavities 11.

Figure 2:
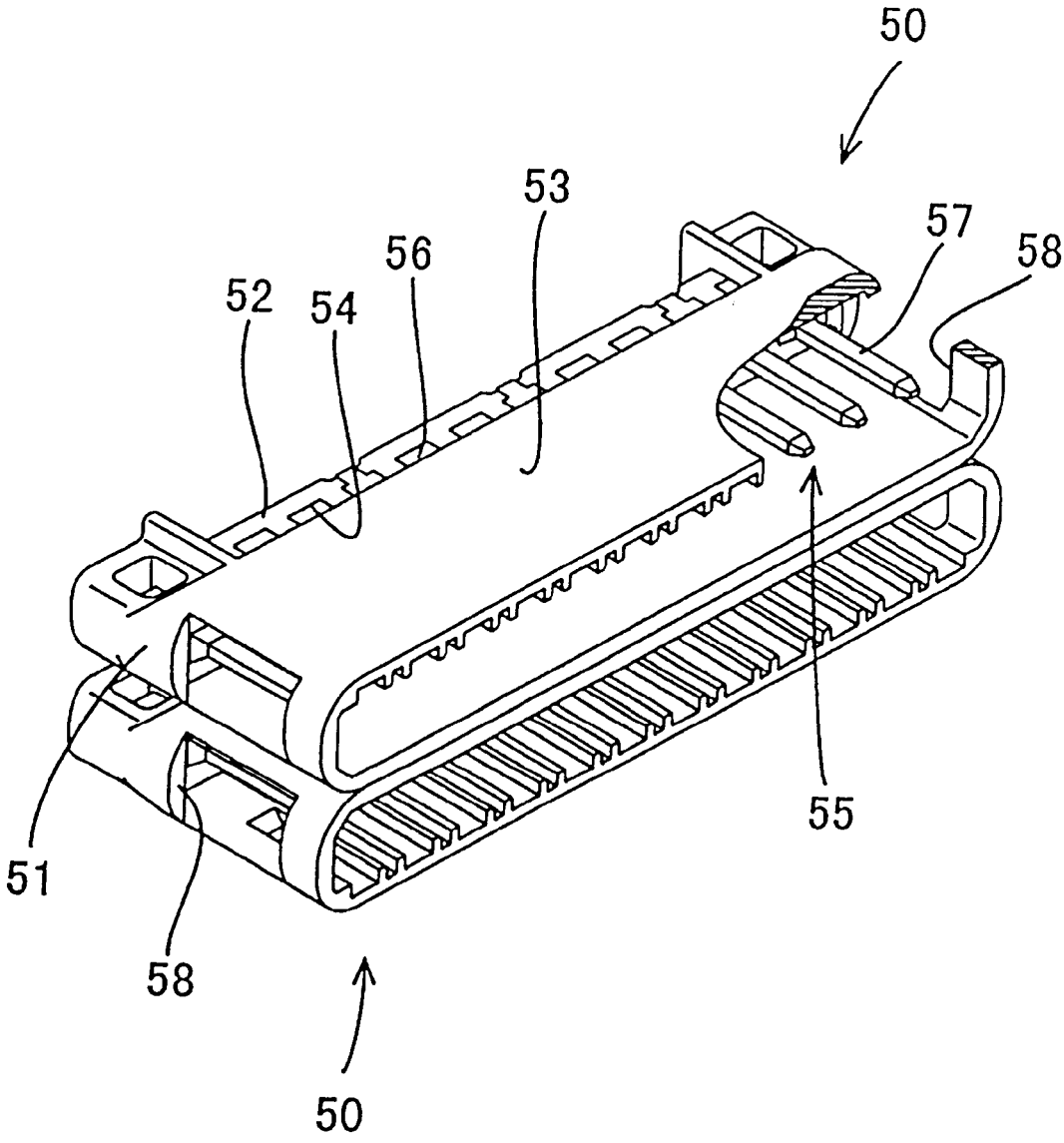
FIG. 2 is a partly cut-away perspective view of bus bar holders that engage the housing, seal member and seal holder of FIG. 1.
Figure 4:
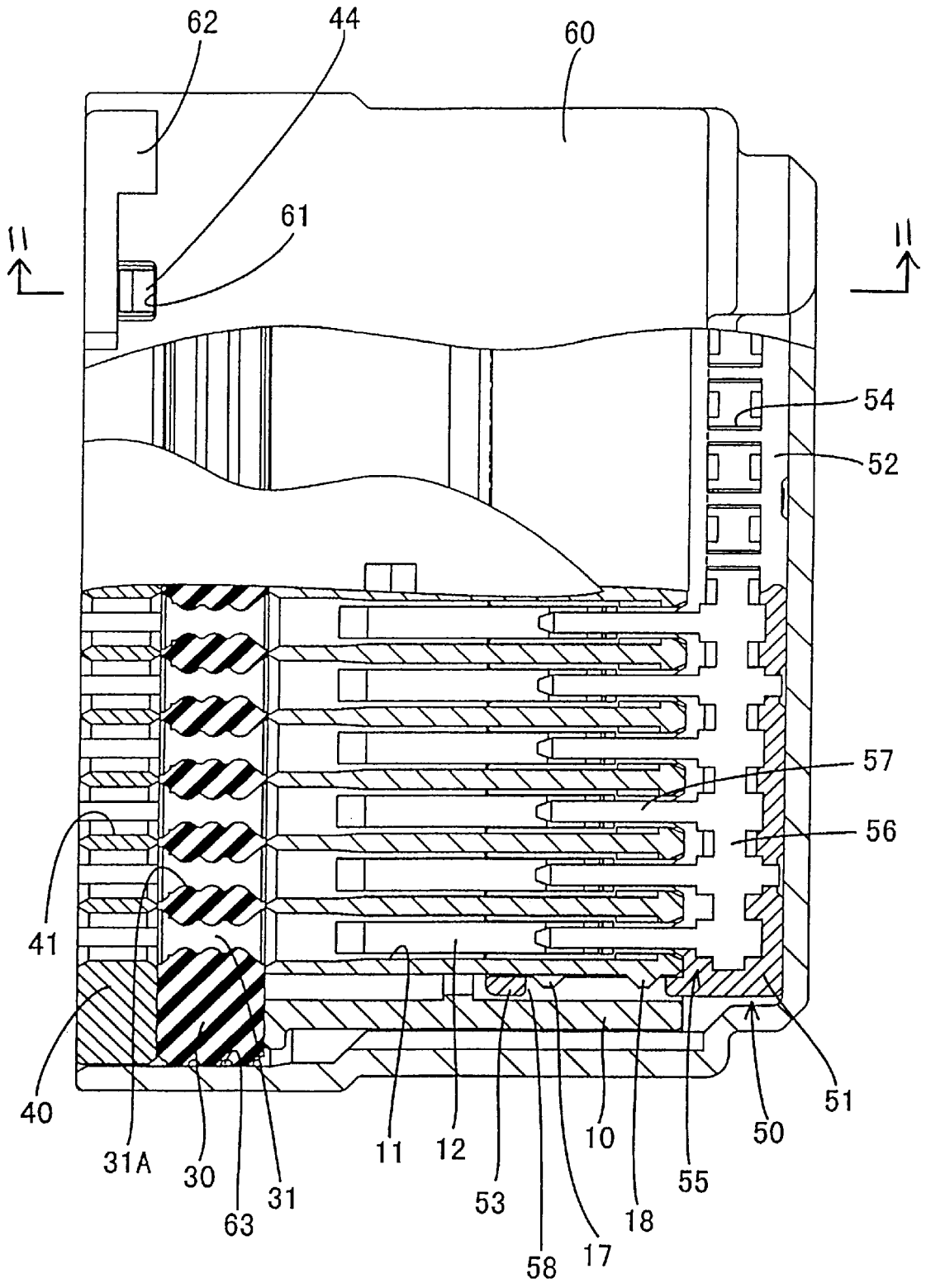
FIG. 4 is a partly cut-away plan view of the connector in an assembled state.
Figure 5:
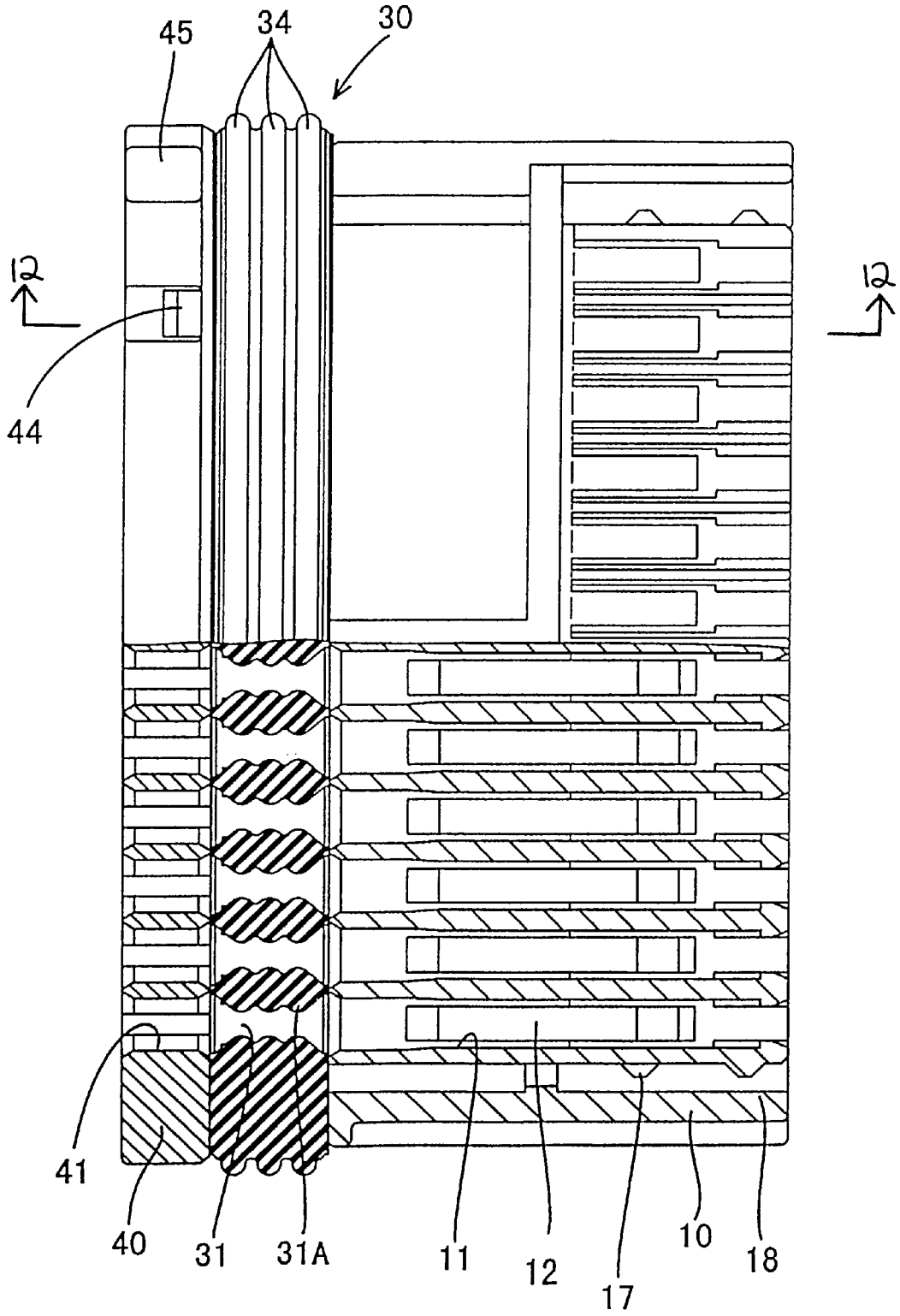
FIG. 5 is a partly cut-away plan view showing the sealing member and the seal holder installed on the housing.
Figure 6:
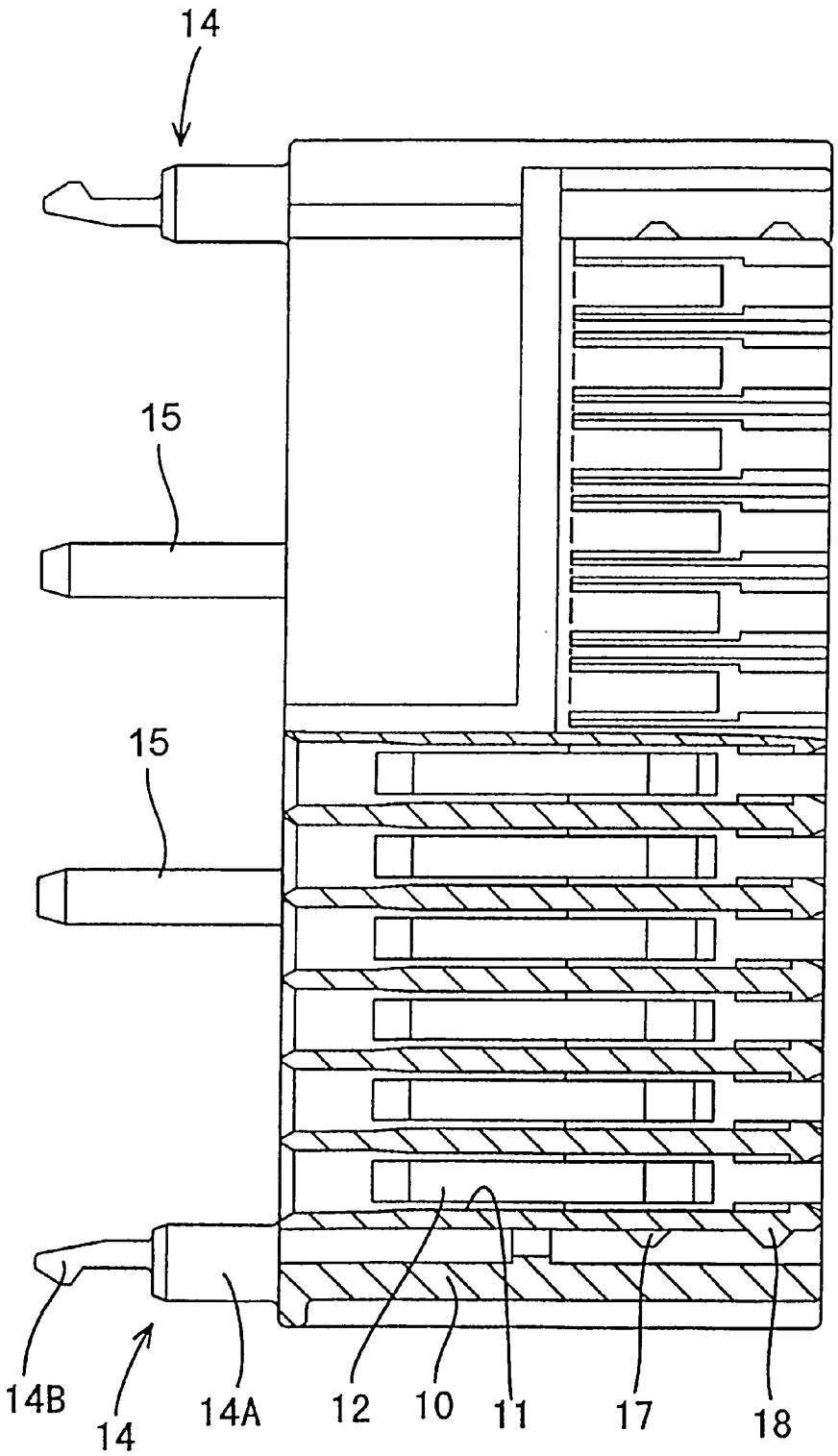
FIG. 6 is a partly cut-away plan view of the housing.
Figure 9:
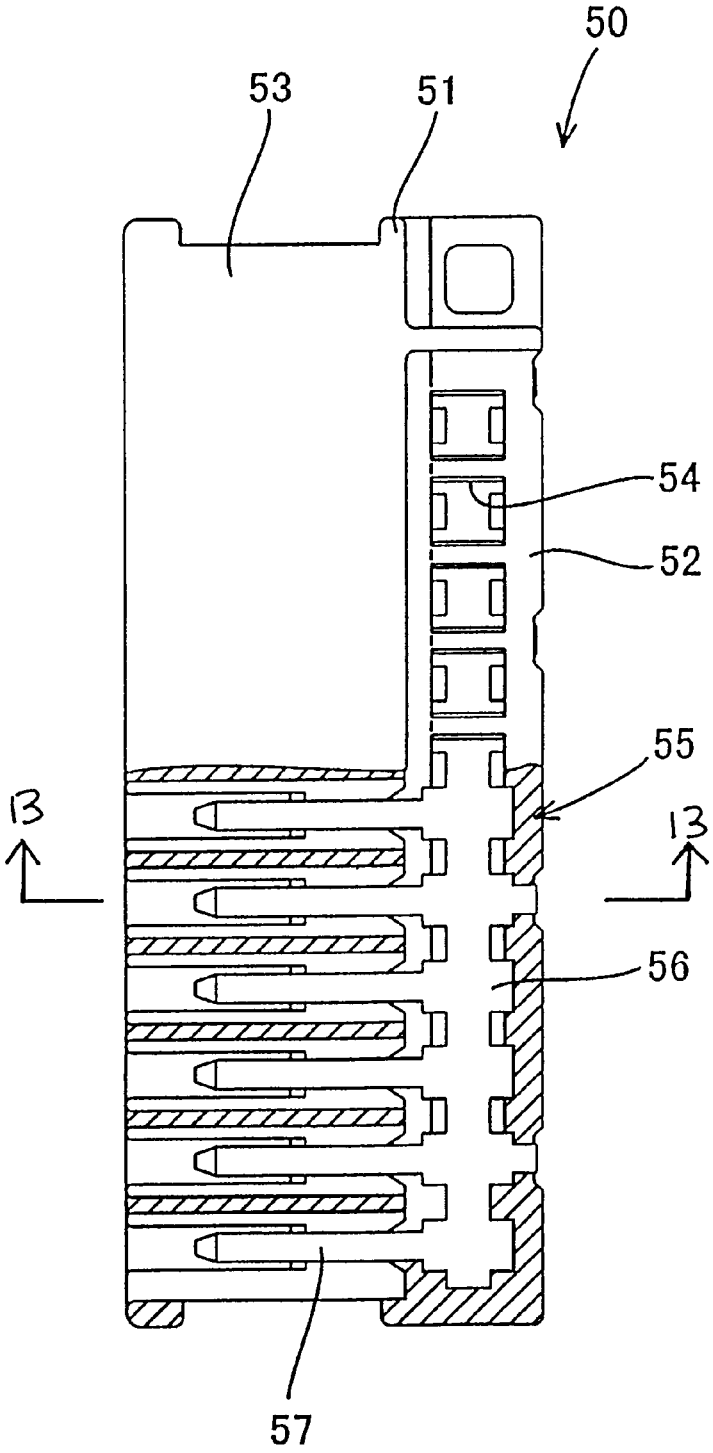
FIG. 9 is a partly cut-away plan view of a bus bar holder.
Figure 10:
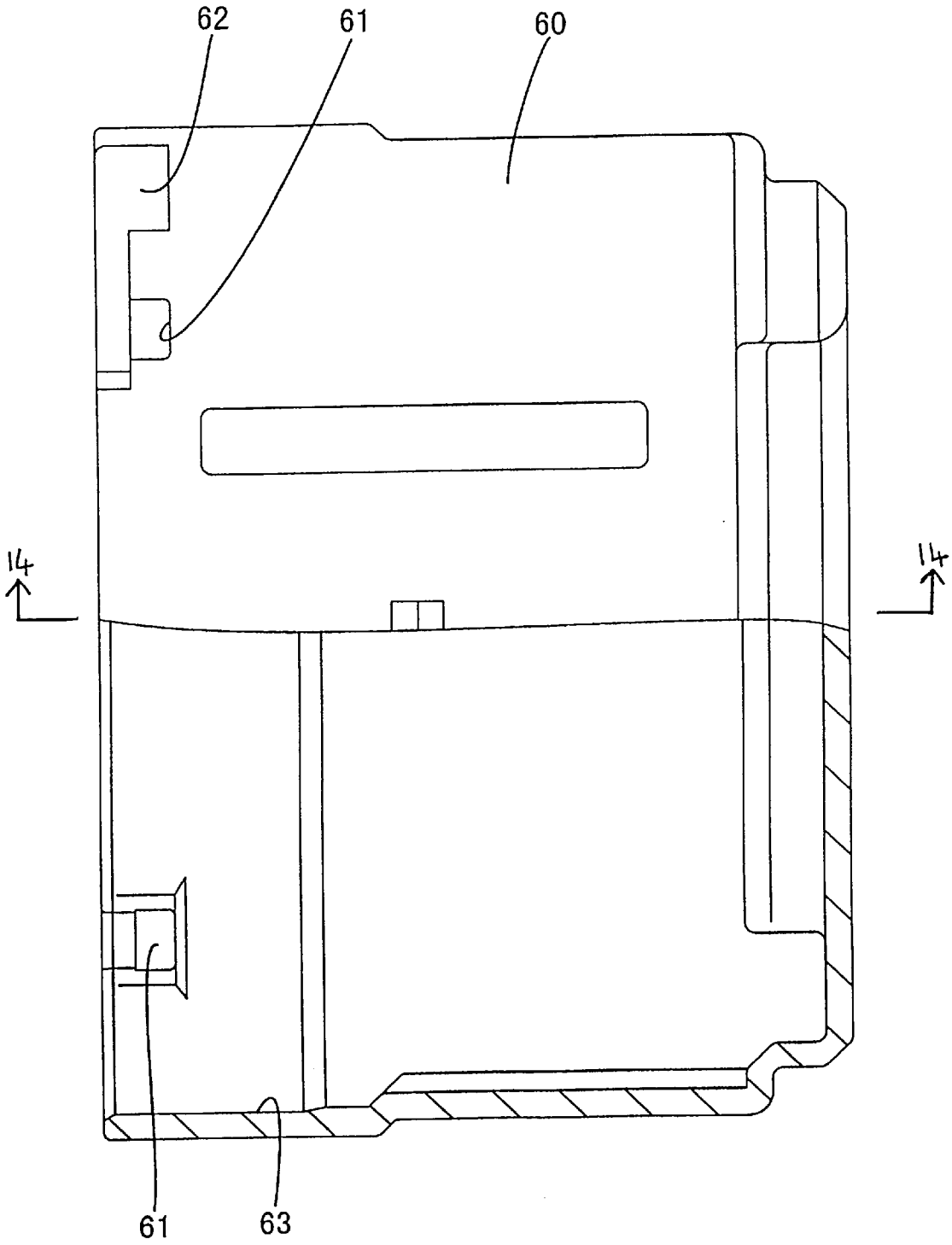
FIG. 10 is a partly cut-away plan view of the cap.

As shown in FIGS. 2, 4 and 9, each bus bar unit 50 is composed of a holding member 51 made of a relatively rigid synthetic resin material and a metal bus bar 55 integrated with the holding member 51 by insert molding. The holding member 51 has a wide sheet-shaped holding portion 52 and a flat cylindrical portion 53 projecting rearward (direction toward the housing 10) from the sheet-shaped holding portion 52. The bus bar 55 includes a plurality of connection pieces 57 projecting in parallel with each other in the shape of a cantilever from an edge of a belt-shaped carrier 56. The bus bar 55 is held with the carrier 56 disposed along the sheet-shaped holding portion 52 and with connection pieces 57 facing the cylindrical portion 53. Punched holes 54 are formed on the sheet-shaped holding portion 52 in correspondence to the gaps between adjacent connection pieces 57 projecting from the carrier 56. In the process of producing the bus bar unit 50, a portion of the carrier 56 facing each punched hole 54 is punched with a punch and die in correspondence to a predetermined connection pattern. As a result, the carrier 56 is divided (not shown) into a plurality of bus bars 55. One bus bar 55 has at least three connection pieces 57. A plurality of terminals 20 are connected by each bus bar 55 through the connection pieces 57.

Each bus bar unit 50 is installed on the housing 10 in a direction forward therefrom such that the cylindrical portion 53 covers the upper-row cavities 11 or the lower-row cavities 11. As shown in FIGS. 4 and 11, when the bus bar unit 50 has been installed on the housing 10, the connection pieces 57 are connected with the terminals 20. Connection patterns can be discriminated from each other by, for example, changing the color of the holding member 51 of the bus bar unit 50. The upper part of the holding member 51 and the lower part thereof are not symmetrical with each other. Thus, the required bus bar unit 50 can be installed on the housing 10 in a correct direction, and a group of the terminal fixtures 20 can be connected in a correct pattern by checking colors and directions of the holding members 51.

As shown in FIGS. 2 and 4, a guide groove 58 extending longitudinally is formed at each of right and left widthwise edges of the cylindrical portions 53. As shown in FIGS. 1 and 4–6, front and rear locking projections 17 and 18 corresponding to the guide grooves 58 are formed on the housing 10. Each bus bar unit 50 is brought to a temporary locking position by locking the rear end of the cylindrical portion 53 and that of the guide groove 58 by the locking projections 17 and 18, with the locking projections 18 positioned in the guide grooves 58. In this state, the bus bar unit 50 is held at a temporary locking position. In this state, the connection piece 57 is placed at a retracted position at which it does not contact the terminal 20, thus preventing generation of resistance at the time of the insertion of the terminal 20. The bus bar unit 50 is then brought to a normal or final installation position by locking the front end of the guide grooves 58 and the rear end thereof to the locking projections 17 and 18 respectively, with the front and rear ends of the guide grooves 58 sandwiching the locking projections 17 and the locking projections 18.

Figure 3:
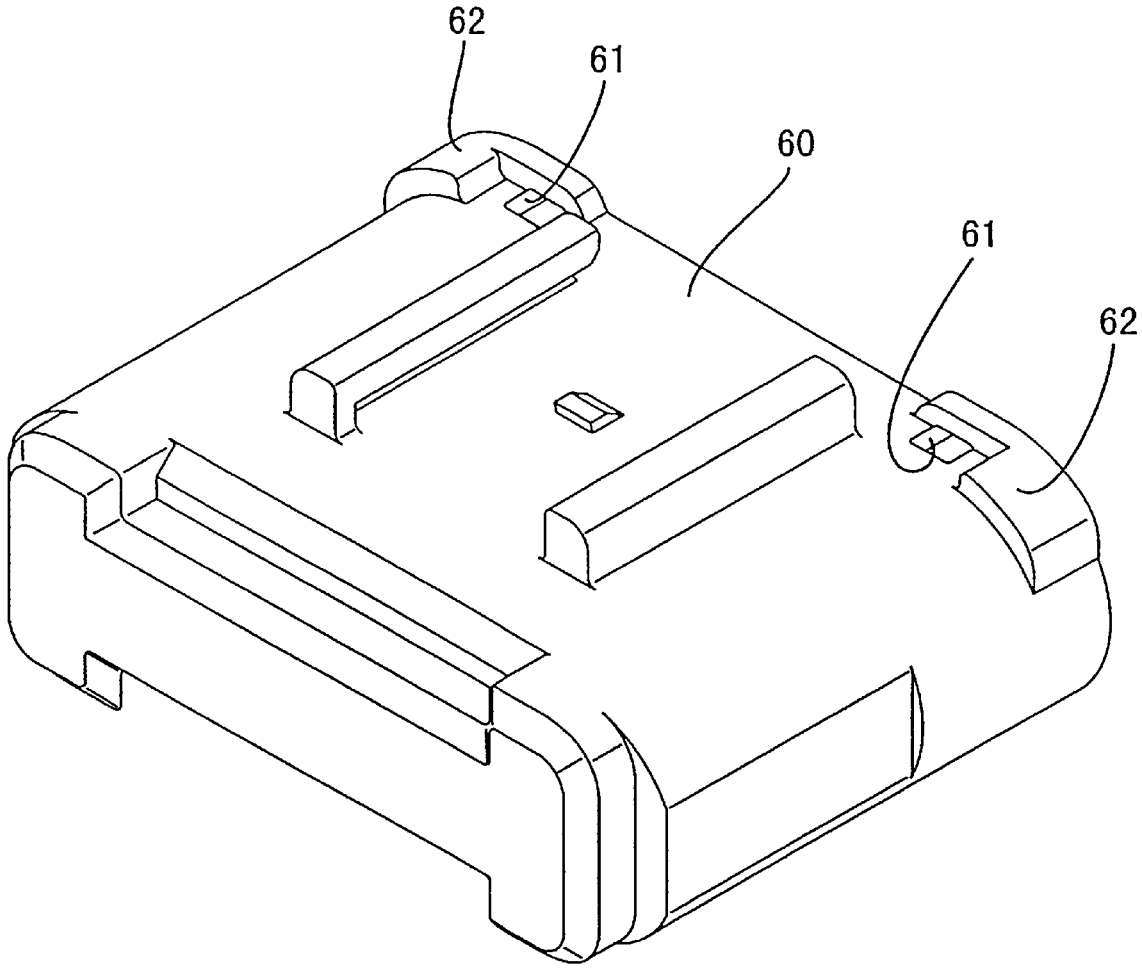
FIG. 3 is a perspective view of a cap that covers the housing of FIG. 1 and the bus bar holder of FIG. 2.

The cap 60 is made of a relatively rigid synthetic resin material. As shown in FIG. 3, the cap 60 is oval-shaped in a front view and has a closed bottom. Locking holes 61 to which the locking projections 44 of the seal holder 40 lock, as shown in FIG. 11, are formed at the edge of the open mouth of the cap 60. The cap 60 is locked in the installed state by the engagement between the locking projections 44 and the locking holes 61. Relief portions 62 (FIG. 7)

projecting outwardly are formed on the edge of the open mouth of the cap 60 to prevent the cap 60 from interfering with the index projections 45 of the seal holder 40. The region of the inner peripheral surface of the cap 60 near the edge of its open mouth is formed as a sealing surface 63 with which the lip portion 34 formed on the peripheral edge of the sealing member 30 contacts elastically.

The assembly procedure is as follows:

Initially, the sealing member 30 is installed temporarily on the housing 10 such that the holding projections 14 and the deformation prevention projections 15 are fitted in the holes 32 and 33, respectively. Then, with the sealing member 30 sandwiched between the seal holder 40 and the housing 10 (FIG. 5), the seal holder 40 is installed on the housing 10 by fitting the locking pieces 14B of the projections 14 into the holes 42 and by fitting the front end of the projections 15 into the holes 43. In the front portion of the housing 10, the bus bar unit or units 50 are installed at the temporary locking position. Then, the terminals 20 are inserted through the openings 41 and the holes 31 into the cavities 11. Thereafter, each bus bar unit 50 is pressed to the normal installation position from the temporary locking position. As a result, the terminals 20 are connected in a predetermined pattern. If any terminal 20 is inserted incompletely into the cavity 11, when the bus bar unit 50 is pressed to the normal installation position, the corresponding lance 12 (FIGS. 11 and 12) projects outward from the housing 10. Thus, the pressing of the bus bar unit 50 is prevented. Therefore, it is possible to detect an incomplete insertion of the terminal fixture 20 into the cavity 11.

When the bus bar unit or units 50 are in the normal installation position, finally, the cap 60 is installed on the housing 10 in such a manner that the cap 60 covers the housing 10 and the bus bar units 50. The lip portion 34 formed on the periphery of the sealing member 30 prevents water from penetrating into the cap 60 between the inner periphery of the cap 60 and the periphery of the sealing member 30. Further, the lip portion 31A of each sealing hole 31 contacts the periphery of the respective wire 25 closely, the inner periphery of each fit-in hole 32 contacts the periphery of the respective holding projection 14, and the inner periphery of each fit-in hole 33 contacts the periphery of the respective deformation prevention projection 15. Therefore, water can be prevented from penetrating into the sealing member 30 from outside.

As described above, in this embodiment, the sealing member seals the wires 25 and the gap between the bus bar unit 50 and the connector housing 10. Thus, this waterproof connector of the present invention uses a smaller number of parts than a conventional waterproof connector. The cap 60 waterproofs the connector housing 10. Thus, even if the upper or lower row of the cavities is vacant, it is unnecessary to take any particular waterproofing measure.

Further, the sealing member 30 is installed on the connector housing 10 by placing it in position using the projections 14 and 15. Thus, the sealing member 30 has a reliable sealing function with respect to the cap 60 and each wire 25.

Because the seal holder 40 is asymmetrical, an operator can recognize its orientation, namely, the address of the terminal insertion opening 41. Thus, the operator can insert the terminals 20 into the predetermined cavities 11 correctly. Further, the terminals 20 can be connected in the correct pattern.

The sealing member 30 and the housing 10 have a 180° rotation symmetry axis respectively. Thus, in assembling the housing 10, the sealing member 30, and the seal holder 40 by an automatic machine, it is unnecessary to provide a parts feeder for supplying these parts to the automatic machine with a mechanism for discriminating the orientation of the parts and correcting the orientation thereof. Thus, the parts feeder can have a simple construction.

Further, to discriminate the orientation of the seal holder 40, the peripheral configuration thereof may be entirely oval and the index projections 45 may be formed on only a portion of the peripheral surface of the seal holder 40. The index projections 45 allow the orientation of the seal holder 40 to be recognized easily and reliably.

The present invention is not limited to the embodiments described, but may be varied, for example, as described below.

(1) In the above description, the seal holder has a configuration asymmetrical with respect to the widthwise arrangement plane of the terminals, i.e. has a configuration that is vertically asymmetrical, but within the present invention, the seal holder may also have a configuration asymmetrical (horizontally asymmetrical) with respect to a line perpendicular to the widthwise arrangement plane of the terminals. That is, the seal holder can be allowed to have a configuration asymmetrical with respect to the widthwise arrangement plane and with respect to the line perpendicular to the widthwise arrangement plane.

(2) In the above description, the sealing member and the housing have a 180° rotation symmetry axis with respect to the line of insertion of the terminal fixtures. But within the present invention, either the housing or the sealing member may have a 180° rotation symmetry axis, and either the housing or the sealing member may have an asymmetrical configuration (directional configuration).

(3) In the above description, the terminals are arranged widthwise in upper and lower rows. But within the present invention, the terminals may alternatively be in one row or three or more rows.

(4) In the above description, to allow the seal holder to have an asymmetrical configuration, index projections are formed on the peripheral surface of the seal holder. But within the present invention, one or more concave portions may be formed on the peripheral surface of the seal holder to allow the seal holder to have an asymmetrical configuration.

Although the invention has been described above in relation to particular embodiments, many variations are possible within the spirit and scope of the invention herein described, as will be clear to those skilled in the art, once given this disclosure.

What is claimed is:

1. A waterproof connector for electrical terminals, comprising:

a terminal housing having a front end and a rear end and a plurality of cavities extending in a direction from the front end to the rear end of the terminal housing and adapted to receive electrical terminals, said cavities being arranged in at least one row;

at least one bus bar installed on said terminal housing from said front end of the terminal housing, whereby the at least one bus bar projects into said cavities of said terminal housing to make contact with the electrical terminals when said electrical terminals are installed in the terminal housing;

a cap installable on said housing from said front end of so as to cover said housing and said bus bar; and a sealing member mounted at said rear end of said terminal housing and having a plurality of apertures through which said electrical terminals pass into said cavities, said apertures sealing against electrical wires connected to said electrical terminals, said sealing member having a periphery which seals against an inner peripheral surface of said cap when said cap is installed on the terminal housing.

2. A waterproof connector according to claim 1, further comprising a seal holding member that locks to said terminal housing so that said sealing member is sandwiched between said seal holding member and said terminal housing, said seal holding member and said cap having cooperating locking members.

3. A waterproof connector according to claim 2, wherein one of said terminal housing and said seal holding member has at least one locating device that positions said sealing member.

4. A waterproof connector according to claim 1, wherein said cavities are elongate and parallel, and are symmetrically arranged in at least one planar array to form at least one of (a) a first symmetry plane which is parallel to or coincident with said planar array, and (b) a second symmetry plane which is perpendicular to said planar array, said seal holding member having an external shape which is asymmetrical with respect to at least one of said first symmetry plane and said second symmetry plane.

5. A waterproof connector according to claim 4, wherein said sealing member and said terminal housing are symmetrical with respect to a 180° rotation about an axis parallel to a line of insertion of said terminals.

6. A waterproof connector according to claim 4, wherein at least one of a convex portion and a concave portion is formed on a peripheral surface of said seal holding member so as to give said seal holding member said asymmetrical external shape.

7. A waterproof connector according to claim 1, further comprising a bus bar holder which holds said bus bar.

8. A waterproof connector for electrical terminals, comprising:

a terminal housing having a front end and a rear end and a plurality of cavities extending in a direction from the front end to the rear end of the terminal housing, said cavities being arranged in at least one row;

a plurality of electrical terminals received in said cavities, each terminal being secured to an electrical wire extending out through said rear end of the terminal housing;

at least one bus bar installed on said terminal housing from said front end of the terminal housing, whereby said at least one bus bar projects into said cavities of said terminal housing so as to make contact with said electrical terminals;

a cap installed on said terminal housing from said front end of said terminal housing so as to cover said terminal housing and said bus bar; and a sealing member mounted at said rear end of said terminal housing and having a plurality of apertures through which electrical wires pass, said apertures sealing against said electrical wires, said sealing member having a periphery which seals against an inner peripheral surface of said cap.

9. A waterproof connector according to claim 8, further comprising a seal holding member that locks to said terminal housing so that said sealing member is sandwiched between said seal holding member and said terminal housing, said seal holding member and said cap having cooperating locking members.

10. A waterproof connector according to claim 9, wherein one of said terminal housing and said seal holding member has at least one locating device that positions said sealing member.

11. A waterproof connector according to claim 8, wherein said cavities are elongate and parallel, and are symmetrically arranged in at least one planar array to form at least one of (a) a first symmetry plane which is parallel to or coincident with said planar array, and (b) a second symmetry plane which is perpendicular to said planar array, said seal holding member having an external shape which is asymmetrical with respect to at least one of said first symmetry plane and said second symmetry plane.

12. A waterproof connector according to claim 11, wherein said sealing member and said terminal housing symmetrical with respect to a 180° rotation about an axis parallel to a line of insertion of said terminals.

13. A waterproof connector according to claim 11, wherein at least one of a convex portion and a concave portion is formed on a peripheral surface of said seal holding member so as to give said seal holding member said asymmetrical external shape.

14. A waterproof connector according to claim 8, further comprising a bus bar holder which holds said bus bar.

* * * * *